US007002107B2

(12) United States Patent
Nooh

(10) Patent No.: US 7,002,107 B2
(45) Date of Patent: Feb. 21, 2006

(54) ELECTRIC CLAY AND EARTHENWARE OVEN FOR GENERAL PURPOSE HEATING, COOKING, AND BAKING IN A HOUSE, RESTAURANTS AND THE LIKE

(76) Inventor: Abulsamad Moahammed H. Nooh, P.O. Box 116224, Jeddah 21391 (SA)

( * ) Notice: Subject to any disclaimer, the term of this patent is extended or adjusted under 35 U.S.C. 154(b) by 0 days.

(21) Appl. No.: 10/843,271

(22) Filed: May 10, 2004

(65) Prior Publication Data

US 2005/0258161 A1 Nov. 24, 2005

(51) Int. Cl.
*A21B 1/06* (2006.01)
*A21B 1/50* (2006.01)
*F27D 1/10* (2006.01)

(52) U.S. Cl. ..... 219/392; 219/391; 219/408; 219/429; 219/432; 219/433

(58) Field of Classification Search ..... 219/391, 219/392, 386, 406–408, 415, 429, 432, 433
See application file for complete search history.

(56) References Cited

U.S. PATENT DOCUMENTS 3,777,118 A * 12/1973 Creus ..... 219/394
4,048,473 A * 9/1977 Burkhart ..... 219/389
4,355,570 A * 10/1982 Martin et al. ..... 99/446
4,373,511 A * 2/1983 Miles et al. ..... 126/369
5,976,591 A * 11/1999 Vieira Da Silva ..... 426/233
6,307,193 B1 * 10/2001 Toole ..... 219/735
2003/0143309 A1 * 7/2003 Kindie et al. ..... 426/496

FOREIGN PATENT DOCUMENTS

DE 10257820 B3 * 4/2004
JP 2001201050 A * 7/2001

OTHER PUBLICATIONS

"Romertopf Clay Baker's Guide," printed Feb. 7, 2005, from http://fantes.com/romertopf.htm.*

* cited by examiner

*Primary Examiner*—Joseph Pelham
(74) *Attorney, Agent, or Firm*—Abelman, Frayne & Schwab

(57) ABSTRACT

An oven has an insulator placed between an inner cavity and an outer housing. The inner cavity is a one-piece clay pot with the top and bottom having equal inside diameters while the middle portion is larger in diameter, to facilitate heat circulation. The heating elements are connected to an electric circuit and are controlled by a control panel. The control panel has a power switch, a thermostat, a timer, an indicator lamp, and a temperature indicator. The heating elements are circular in shape and are located around the bottom inside of the inner cavity. The oven may be accompanied with accessories for baking and for removing baked dough.

19 Claims, 6 Drawing Sheets

FIG. 5
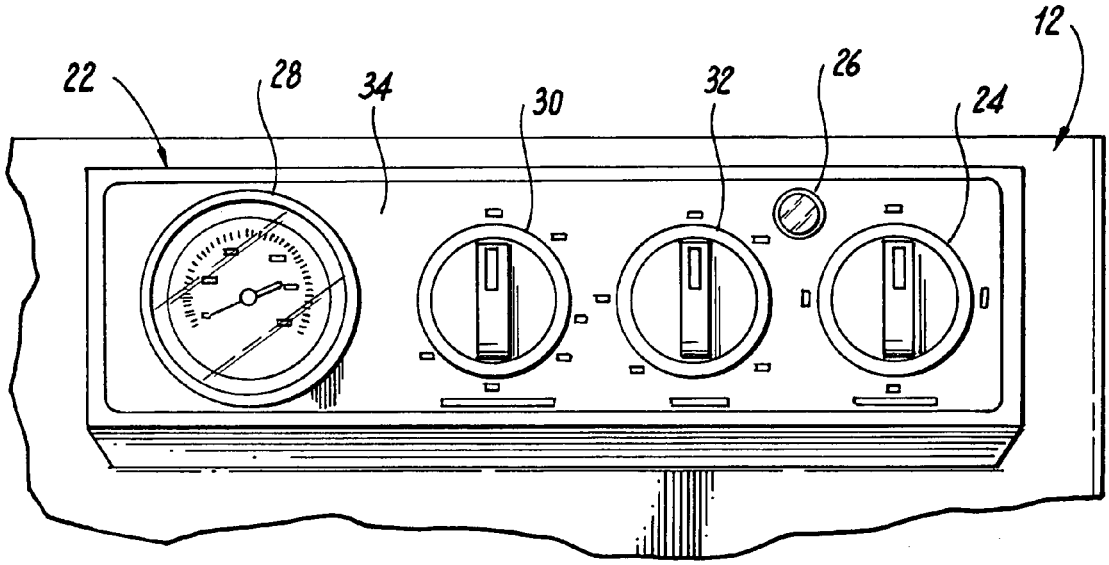
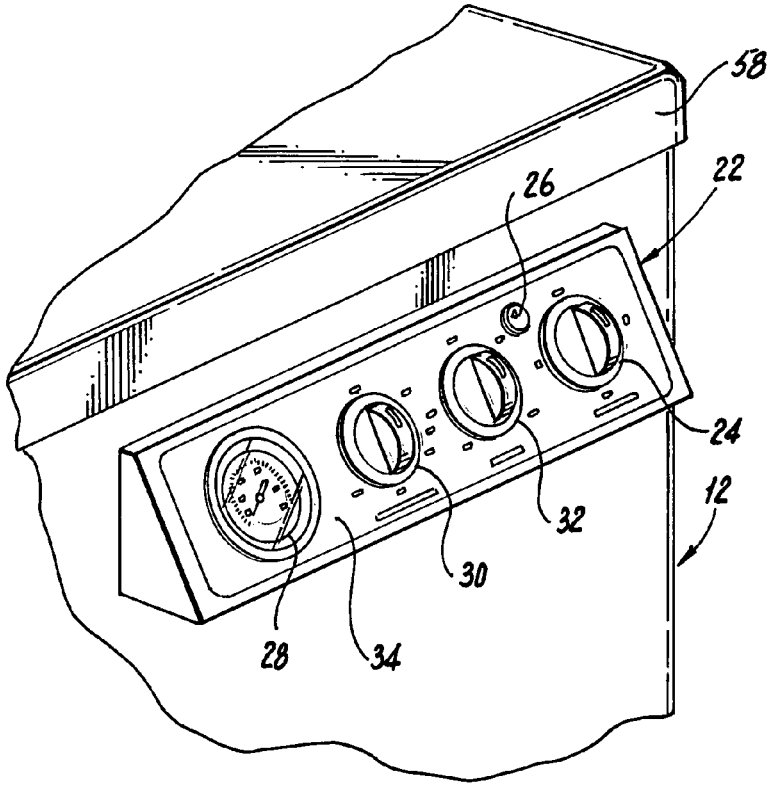
FIG. 6

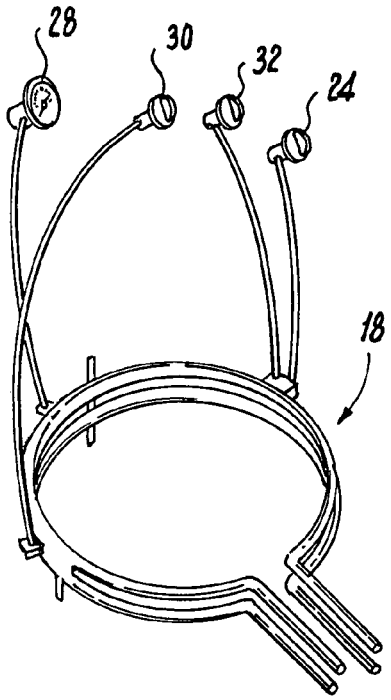
FIG. 12
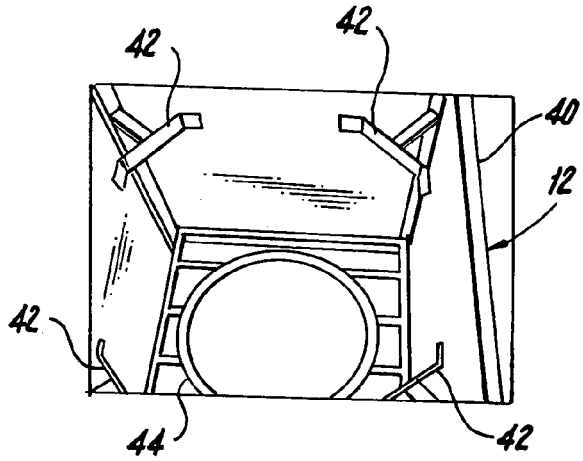
FIG. 13
FIG. 14
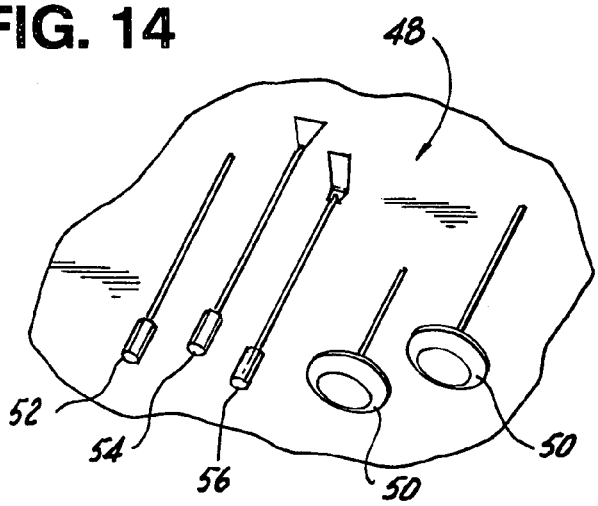

ELECTRIC CLAY AND EARTHENWARE OVEN FOR GENERAL PURPOSE HEATING, COOKING, AND BAKING IN A HOUSE, RESTAURANTS AND THE LIKE

BACKGROUND OF THE INVENTION

1. Field of the Invention

This invention relates to an electric clay and earthenware oven for general purpose heating, cooking, and baking in a house, restaurants and the like.

2. Description of the Related Art

Traditionally, clay ovens are preferred for cooking due to several advantages. Primarily, cooking in earthenware imparts a special taste to food because of the natural properties of clay which includes its slow cooking characteristics. Such taste and flavor is not possible in ordinary metal utensils now used for cooking, and therefore event today, special provisions are made in households and restaurants for cooking in clay utensils.

Cooking in earthenware requires special arrangements, mainly the supply of a distributed source of heating. Traditionally, meals are cooked outdoors by using burning wood or charcoal as the source of heat. Often, holes are dug in the ground where the earthen pot is placed over wood or charcoal which is then ignited. The process is cumbersome and also leads to the production of a lot of smoke, fumes, and a bad smell. These disadvantages, added with the long time taken for preparing the fire to reach a state which is optimum for cooking and the hazards associated with the use of open fire, have made the process unpopular.

Therefore, there is a need of an oven that can provide simple and fast cooking, but at the same time, gives food the same flavor and taste as achieved using earthenware.

BRIEF SUMMARY OF THE INVENTION

Therefore, the basic object of the present invention is to provide for a cooking device that is simple and cost effective yet imparts meals cooked therein with the taste and flavor of food cooked traditionally in earthenware.

Another object of the present invention is to provide for a cooking device that does not emit fumes or smoke while cooking.

A further object of the present invention is to provide for a cooking device which can be easily moved and transported.

Yet a further object of the present invention is to provide for a cooking device which can be used to cook various meals and preparations.

Yet another object of the present invention is to provide for a cooking device whose exterior does not get heated up even after long hours of operation.

Accordingly, the present invention provides an electric clay/earthenware oven comprising a housing having a cavity made of clay which accommodates the heating elements.

The electric oven of the present invention is a new modern-type oven which is easy to use and to move. The oven has an insulator preferably made of rock wool or glass wool placed between the clay cavity and the outer housing. The outer housing may have a plurality of wheels fitted at the bottom for easy movement. The wheels may be four to six in number. The clay cavity has a cover made from material selected from clay or a metal, preferably steel. The cavity is preferably a one piece clay pot with the top and bottom having equal inside diameters while the middle portion is larger in diameter. This shape facilitates heat circulation. The heating elements are connected to an electric circuit and are controlled by a control panel. The control panel preferably has a power switch, a thermostat, a timer, an indicator lamp, and a temperature indicator. The heating elements are preferably circular in shape and are located around the bottom inside of the clay cavity. The oven may be accompanied with accessories for baking and for removing baked dough. A full meal may be prepared using a pot with a plurality of steel nets or shelves, one on top of the other and fitted to the pot. Rice may be cooked in the pot while meat and vegetables may be cooked in the net or shelves.

The device does not generate any smoke or unpleasant smells during cooking. It may be utilized for baking bread and roti, which is a type of unleavened bread, on the inner walls of the clay cavity. Normal meals including meat can be prepared in substantial amounts to feed at least forty people. Most importantly, the device uses the healthy characteristics of cooking using clay which imparts the traditionally recognized flavor and taste.

BRIEF DESCRIPTION OF THE SEVERAL VIEWS OF THE DRAWINGS

The oven of the present invention will now be described with reference to a non-limiting preferred embodiment and accompanying drawings in which:

FIG. 5 is a front elevational view of the control panel;

FIG. 6 is a top front left side perspective view of the control panel;

FIG. 12 is a top perspective view of the electric circuit of FIG. 11;

FIG. 13 is a top front inward perspective view of the interior of the oven without the clay cavity therein; and FIG. 14 is a top plan view of various accessories for use in cooking or baking with the oven.

DETAILED DESCRIPTION OF THE INVENTION

Referring to FIGS. 1–14, the electric oven 10 of the present invention and various cooking utensils and accessories are shown in the various views. As shown in FIGS. 1–2, 4, 9, and 13, the electric oven 10 includes an outer housing 12 having an interior space for receiving an inner cavity 14 which may be placed therein for cooking food placed within the inner cavity 14. In a preferred embodiment, the inner cavity 14 is composed of clay, but other rigid materials and compositions may be used, such as ceramic, earthenware, wood, brick, or other heat-conveying and non-metallic substances which may impart distinctive flavor, taste, or aroma to the food cooked therein. Accordingly, as used herein, the term "clay" includes such other materials and compositions described herein.

Figure 10:
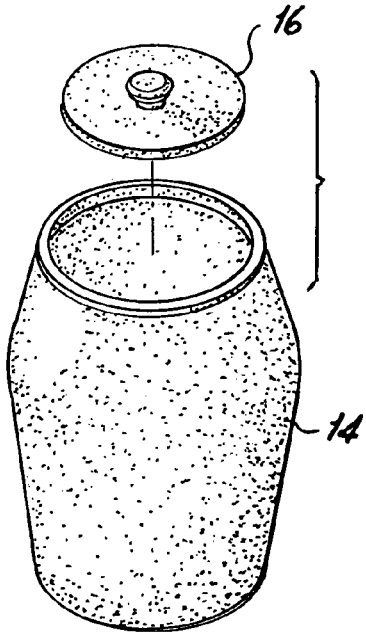
FIG. 10 is a top front perspective view of the clay cavity.

The inner cavity 14 is shown separately in FIG. 10. In a preferred embodiment, the cavity 14 has a special design with the top and bottom inside diameters being substantially equal, but with wider inside diameters in the middle portions between the top and bottom. Such a shape facilitates heat circulation and thereby consumes less power or energy to properly and thoroughly cook the food within the cavity 14. Alternatively, other shaped inner cavities 14 may be used. The cavity 14 may be a one-piece clay pot without a cover. Alternatively, the cavity 14 has a cover 16 which may be composed of clay, or alternatively metal such as steel or stainless steel.

The oven 10 includes a heating source 18 for heating the cavity 14, and therefore the food placed therein. The heating source 18 includes one or more heaters or heating elements, depending on the size of the cavity 14, and at least one heater is fitted near the bottom of the outer housing 12 substantially adjacent to the inner cavity 14 for heating the inner cavity 14 and the food contained therein. Alternatively, the heater is fitted near the bottom of the inner cavity 14 from the inside. Example heating sources 18 including heating elements known in the art are shown in detail in FIGS. 11–12. Any known type of heating elements may be used.

Figure 11:
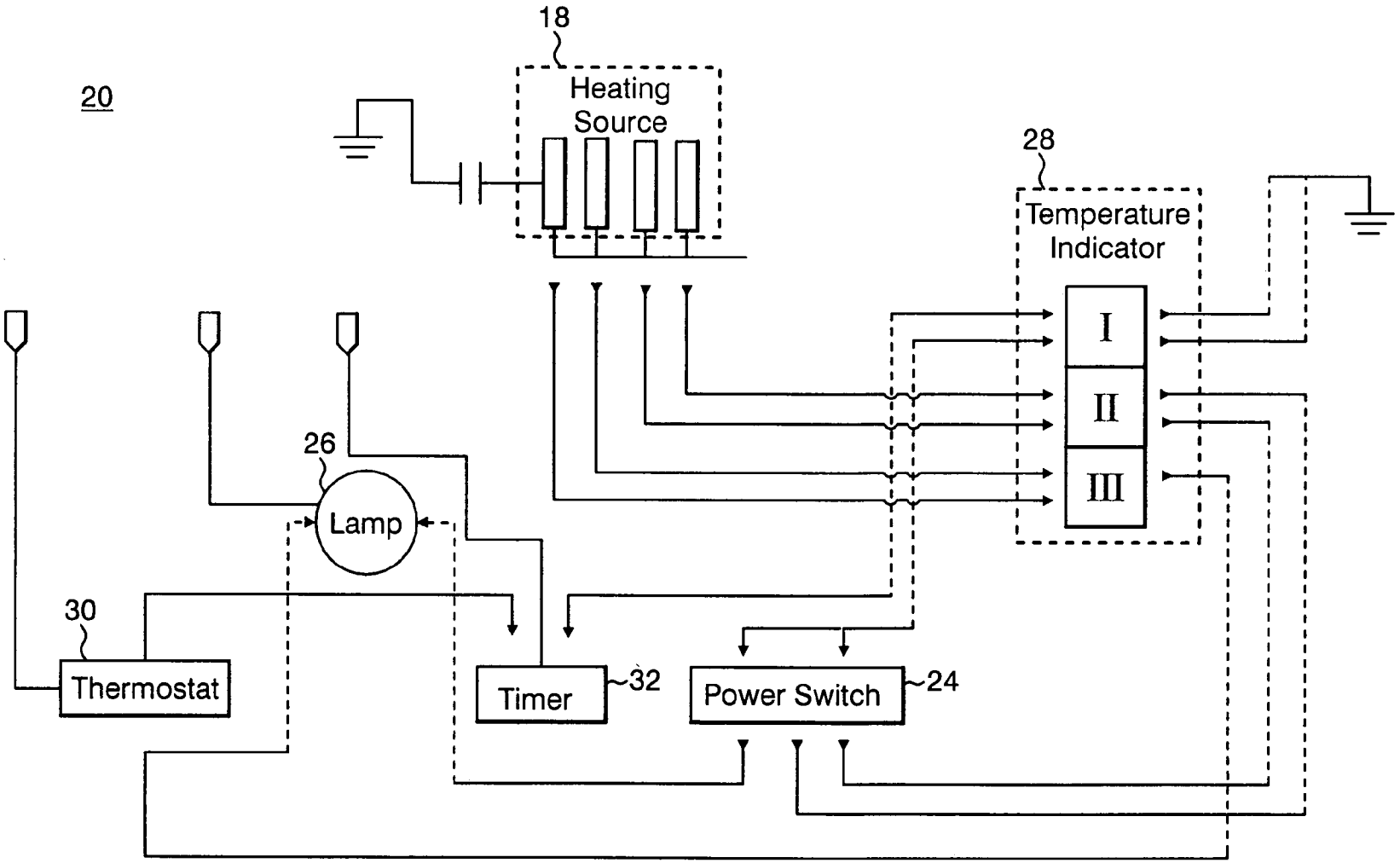
FIG. 11 is a schematic circuit diagram of the electric circuit and heating element used in the oven.

The oven 10 has an electric circuit 20, shown in FIG. 11, which is connected to a control panel 22, shown in FIGS. 1–2 and 5–6. The electric circuit 20 and the control panel 22 which may be any type of electric circuit and control panel known in the art to control the operation of the oven using the control panel 22 as described herein. The electric circuit 20 is connected to a power source such as a battery contained within the housing 12, or to a power outlet via a plug extending through and from the housing 12, to provide electric power to the electric circuit 20 to heat the heating source 18. In an example embodiment shown in FIGS. 11–12, the control panel 22 includes at least one manually actuated control device, such as a power switch 24, a light indicator or lamp 26, a temperature indicator 28, a thermostat 30 to control the temperature, and a timer 32 connected electrically to the heating source 18. The temperature indicator 28 may include a heat sensor positioned substantially adjacent to the cavity 14 for measuring and displaying the temperature of the cavity 14. The timer 32 may, for example, allow for up to about 120 minutes of timed cooking. The various components 24–32 of the control panel 22 may be housed on a plate 34, such as an aluminum plate, mounted to the outside of the housing 12. The various components 24–32 may include knobs, push buttons, analog and/or digital read-outs, or any combination thereof.

Figure 7:
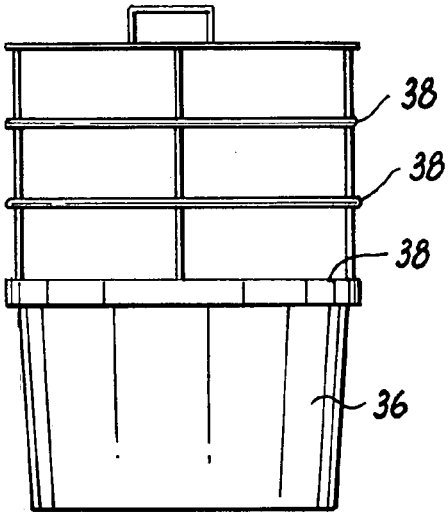
FIG. 7 is a front elevational view of a set of cooking utensils and accessories.
Figure 8:
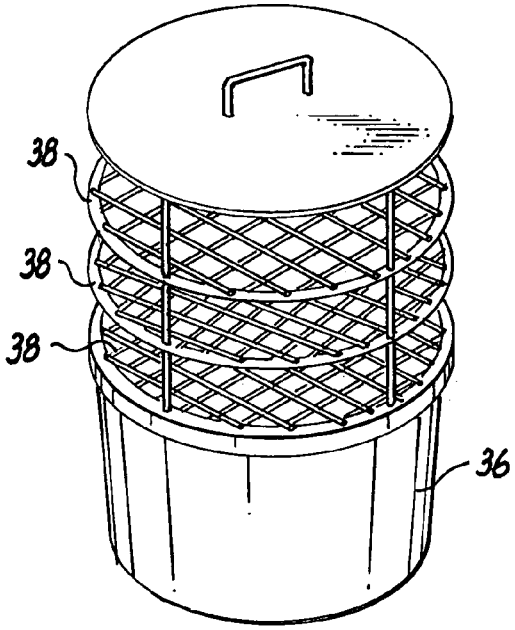
FIG. 8 is a top front perspective view of the cooking utensils and accessories of FIG. 7.
Figure 9:
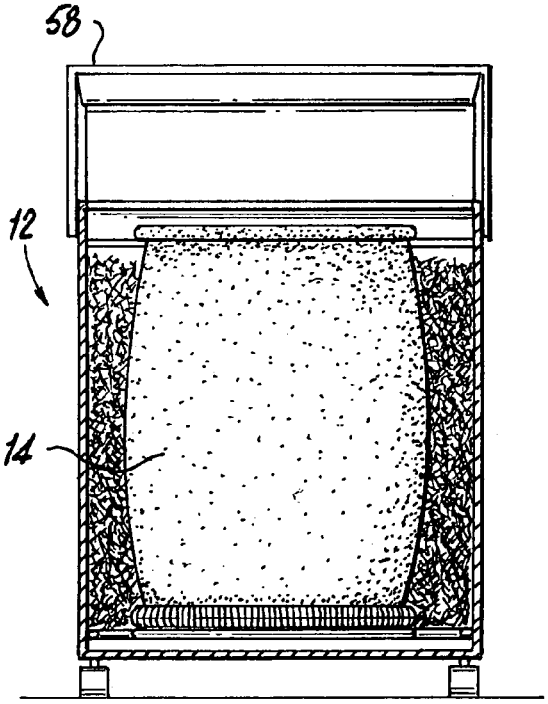
FIG. 9 is a front cross-sectional view of the oven along lines 9—9 in FIG. 2.

FIGS. 7–8 shown various example cooking utensils which hold food within the cavity 14 to be cooked. For example, the cooking utensils may include a pot 36 which may have nets 38 or meshes capable of being placed or stacked one above the other for cooking meat and/or vegetables simultaneously within the cavity 14.

As shown in FIGS. 1–4, 9, and 13, the outer housing 12 includes a case 40 composed of metal and/or combinations or alloys thereof, such as steel or stainless steel. The interior construction of the case 40 in shown in FIG. 13, in which at least one top holder 42 and a bottom seat holder 44 are provided which help in holding the cavity 14 removably and substantially fixed in place within the case 40.

Figure 3:
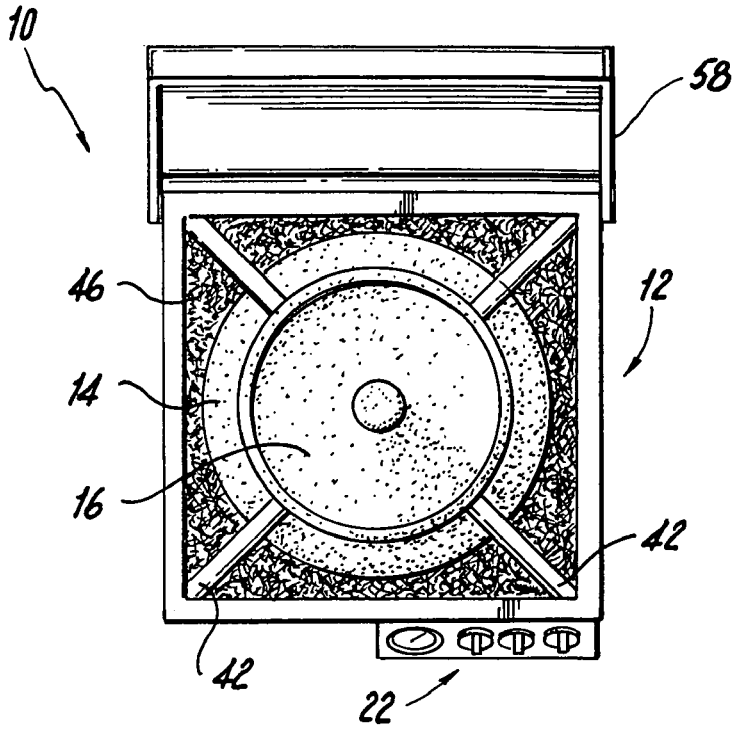
FIG. 3 is a top plan view of the oven along lines 3—3 in FIG. 2.
Figure 4:
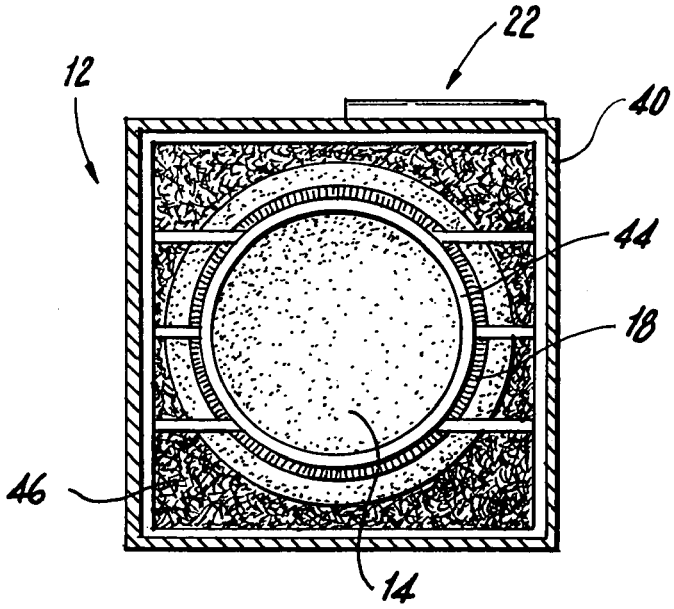
FIG. 4 is a bottom plan view of the oven along lines 4—4 in FIG. 2.

The interior of the case 40 includes a heat insulator 46, shown in FIG. 3, which may be composed of rock wool, glass wool, or other compositions or substances which resist the transfer of heat from the heated cavity 14 to the outer housing 12. In fact, the outer housing 14 remains at a normal or ambient temperature, even after extended hours of use of the oven 10. The composition of the cavity 14, from clay or other materials described herein, also helps in insulating the heat from the outer housing 14. Such insulating properties of the oven 10 and the cavity 14 contribute to a better utilization of power and a more efficient operation of the oven 10 and the cooking of food therein, and also lead to a lessening of the chances of accidents.

Figure 1:
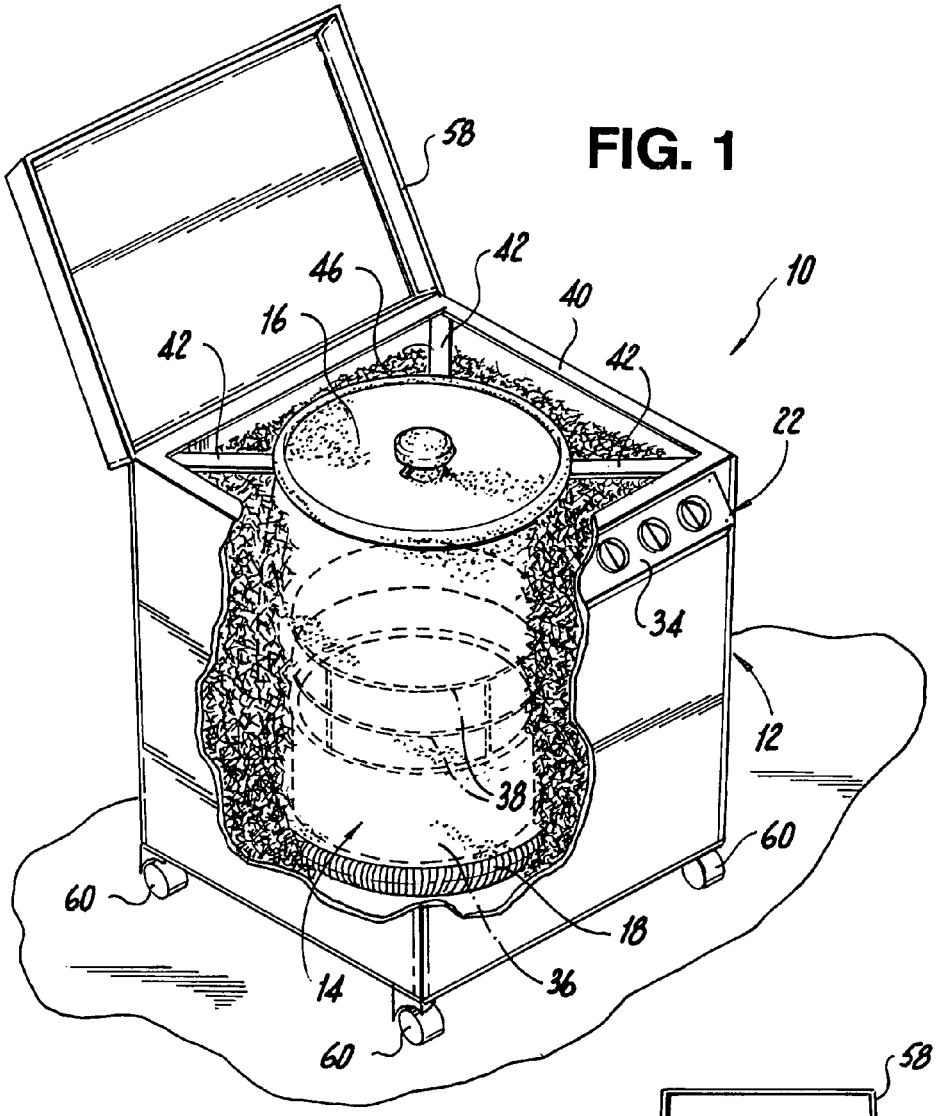
FIG. 1 is a top left front perspective view of the electric oven of the present invention, with a cut-away view showing the clay cavity therein.

As shown in FIG. 1 in conjunction with FIGS. 11–12, the cavity 14 may be positioned substantially adjacent to at least one heating source 18 connected to the control panel 22 having the switch 24, the lamp 26, the temperature indicator 28, the thermostat 30, and the timer 32.

The oven 10 may be included in a kit or assembly in combination with the cavity 14 and the utensils 36–38 in FIGS. 7–8, as well as other accessories 48 and utensils shown in FIG. 14, for example, for baking bread within the cavity 14, and for removing the baked bread from the cavity 14.

METHOD OF OPERATION

In use, the oven 10 is first switched on using the switch 24 in FIG. 5. The timer 32 is set between zero and 120 minutes, and the desired temperature is set using the thermostat 30. The indictor lamp 26 then activates to light up, indicating that the oven 10 is operational. In an example embodiment, the oven 10 may need pre-heating, and so may have to be left to heat for about twenty minutes before putting the food into the cavity 14 therein, for a cooking temperature of about 200 degrees Fahrenheit.

For cooking rice or meat, the cooking utensils and accessories shown in FIGS. 7–8 and 14 may be used. The oven 10 is preferably heated to about 150 degrees Fahrenheit, and then a utensil such as the pot 36 and nets 38 may be inserted into the heated cavity 14. For example, rice may be placed within the pot 36, and meat may be placed on the net 38, with the net 38 permitting even cooking as well as dripping of melting fat and juices from the meat. The combination of food-containing pot 36 and net 38 is put into the cavity 14 of the oven 10 for about 120 minutes on about 200 degrees Fahrenheit. At the end of the stipulated time set by the user, the timer 32 turns off the oven 10 automatically. Optionally, the electric circuit shown in FIGS. 11–12 includes an audible device, such as a bell or buzzer, which is activated by the timer 32 at the end of the stipulated time to make a sound to indicate to the user that the oven 10 has been automatically turned off.

In an example of baking with the oven 10, wheat is first mixed with water as required, and optionally with other materials such as yeast, to form dough. The dough is prepared and optionally shaped as desired. The inner surface of the cavity 14 to be used for cooking the dough, such as the bottom surface, should be wiped with a small amount of water or other substances, such as cooking oil or non-stick chemicals, to clean the surface and/or to prevent the baked dough from sticking to the surface. An accessory shown in FIG. 14, such as the accessory 50, is then used by the user to insert the shaped dough into the inside of the cavity 14. The oven 10 is then covered for about 20 minutes at a predetermined temperature, such as 200 degrees Fahrenheit, after which time the baked bread or roti is taken out using any of the accessories 52–56 shown in FIG. 14.

Figure 2:
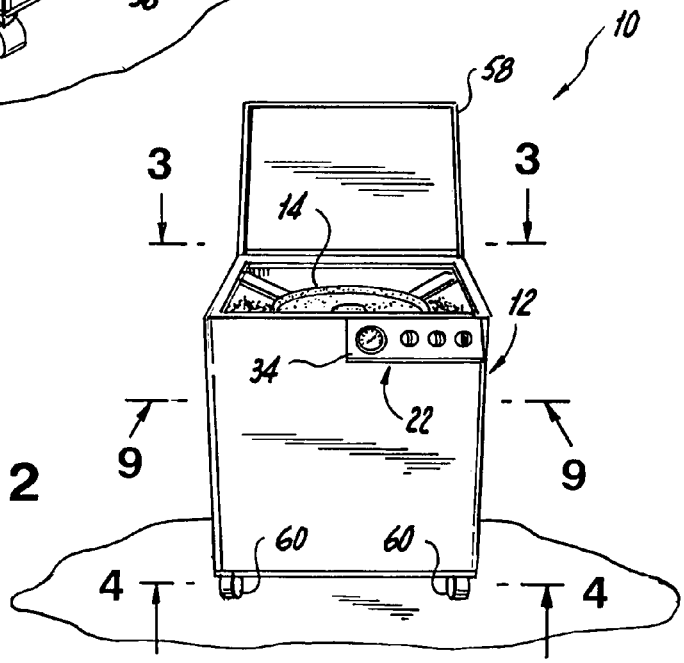
FIG. 2 is a top front perspective view of the oven of FIG. 1.

In an example embodiment, the oven 10 includes a cover 58, such as a hinged lid, shown in FIGS. 1–2, for covering the interior of the oven 10 during use. Wheels 60 and/or casters may be included for moving the oven 10 to different locations.

As shown in the example embodiments herein, the oven 10 may have rectangular cross-sections, and the cavity 14 may have circular cross-sections. Alternatively, the oven 10 may have any arbitrary shape and color. For example, the oven 10 may be configured and dimensioned to be shaped to appear to be a larger version of the cavity 14, and the outer housing 14 may be colored to appear as though the oven 10 is composed of clay itself, thus providing the outside appearance of traditional cooking with clay pots and cavities.

What is claimed is:

1. An electrically-powered oven comprising:

an outer housing having:

an interior space in which a food-containing cavity is inserted;

an insulator placed between the food-containing cavity and an inner surface of the outer housing; and an electrically-powered heating element positioned within the interior space for heating the food-containing cavity;

wherein the food-containing cavity is composed of a material selected from the group of clay, earthenware, and ceramic.

2. The oven as claimed in claim 1, wherein the insulator is composed of a material selected from the group of rock wool and glass wool.

3. The oven as claimed in claim 1, further comprising:

a plurality of wheels fitting at a bottom of the outer housing for easy movement thereof.

4. The oven as claimed in claim 1, wherein the food-containing cavity includes a cover composed of a material selected from clay and metal.

5. The oven as claimed in claim 4, wherein the cover is composed of steel.

6. The oven as claimed in claim 1, wherein the food-containing cavity is a one-piece clay pot.

7. The oven as claimed in claim 1, wherein the food-containing cavity has circular cross-sections;

wherein the cross-sections of a top and a bottom of the food-containing cavity have equal first diameters; and wherein at least one cross-section of a middle portion of the food-containing cavity has a second diameter larger that the first diameter.

8. The oven as claimed in claim 1, further comprising:

a control panel including at least one manually actuated control device; and an electrical circuit, connected to the control panel and controlled by the at least one manually actuated control device, the electrical circuit being connected to the electrically-powered heating element, for controlling the heating of the heating element.

9. The oven as claimed in claim 8, wherein the control panel includes:

a power switch;

a thermostat;

a timer;

an indicator lamp; and a temperature indicator.

10. The oven as claimed in claim 1, wherein the heating element is circular in shape and is positioned at the bottom of the outer housing substantially adjacent to the food-containing cavity.

11. The oven as claimed in claim 1, further comprising:

at least one accessory for use in inserting and removing food from the food-containing cavity positioned within the outer housing.

12. The oven as claimed in claim 11, wherein the at least one accessory is adapted to grasp and remove baked dough from the food-containing cavity.

13. The oven as claimed in claim 1, further comprising:

a pot having at least one net mounted on the top thereof, with the pot adapted to retain food and capable of being inserted into and removed from the food-containing cavity.

14. The oven as claimed in claim 13, wherein the pot is capable of holding rice to be cooked therein.

15. The oven as claimed in claim 13, wherein the at least one net includes a plurality of steel nets forming shelves positioned one on top of the other and fitted to the pot.

16. A kit comprising:

a food-containing cavity composed of a material selected from the group of clay, earthenware, ceramic, wood, and brick; and an electrically-powered oven having:

an outer housing having:

an interior space in which the food-containing cavity is removably inserted;

an insulator placed between the food-containing cavity and an inner surface of the outer housing; and an electrically-powered heating element positioned within the interior space for heating the food-containing cavity.

17. The kit as claimed in claim 16, wherein the insulator is composed of a material selected from the group of rock wool and glass wool.

18. A method for cooking food, the method comprising the steps of:

providing an electrically powered oven having:

an outer housing with an interior space; and an insulator substantially adjacent to an inner surface of the outer housing;

placing the food into a food-containing cavity composed of a material selected from the group of clay, earthenware, ceramic; and placing the food-containing cavity into the interior space of the electrically-powered oven, with the insulator positioned between the food-containing cavity and the inner surface of the outer housing;

heating the food-containing cavity with an electrically-powered heating element positioned within the interior space; and removing the cooked food from the food-containing cavity with an accessory.

19. The method of claim 18, further comprising the step of:

controlling the step of heating using a control panel connected to an electric circuit providing electrical power to the heating element.

* * * * *